United States Patent [19]

D'Amato et al.

[11] 4,241,969

[45] Dec. 30, 1980

[54] LOCKING PLUG

[75] Inventors: Michael J. D'Amato, North Haven; Frank C. Jaconette, Trumbull, both of Conn.

[73] Assignee: Harvey Hubbell, Incorporated, Orange, Conn.

[21] Appl. No.: 76,792

[22] Filed: Sep. 18, 1979

[51] Int. Cl.[3] ..... H01R 13/625

[52] U.S. Cl. ..... 339/88 R; 339/75 P; 339/189 R; 339/14 P

[58] Field of Search ..... 339/88 R, 88 C, 14 P, 339/89 R, 89 M, 90 R, 75 P, 75 M, 91 R, 39–42, 187, 188 R, 189 R, 22 R, 22 B

[56] References Cited

U.S. PATENT DOCUMENTS

| | | | |
|---|---|---|---|
| 2,684,860 | 7/1954 | Rafferty | 285/175 |
| 2,750,571 | 6/1956 | Schmier | 339/103 |
| 3,120,987 | 2/1964 | Degnan | 339/60 |
| 3,390,404 | 6/1968 | Murchison | 339/38 |
| 3,393,395 | 7/1968 | Hubbell | 339/91 |
| 3,500,291 | 3/1970 | Hubbell et al. | 339/91 |
| 3,739,321 | 6/1973 | Murphy et al. | 339/103 B |
| 3,790,914 | 2/1974 | Hough | 339/14 P |
| 3,888,559 | 6/1975 | Geib | 339/46 |
| 3,890,025 | 6/1975 | Gray | 339/14 P |
| 3,950,059 | 4/1976 | Anhalt et al. | 339/75 M |

FOREIGN PATENT DOCUMENTS

| | | | |
|---|---|---|---|
| 486174 | 11/1953 | Italy | 339/41 |
| 500653 | 2/1939 | United Kingdom | 339/41 |

*Primary Examiner*—Howard N. Goldberg
*Assistant Examiner*—Eugene F. Desmond

[57] ABSTRACT

The male portion of a connector assembly of the locking type has blades insertable into slots in the mating female portion, the male portion then being rotatable to lock the blades against direct axial extraction. A spring urged locking pin adjacent the trailing edge of at least one blade normally protrudes from the connector face, is pushed in by the female face, and then protrudes after locking rotation, entering the slot portion vacated by the trailing edge. A rotatable sleeve on the male connector body has a cam surface which, upon rotation of the sleeve in the unlocking direction, first retracts the locking pin, then engages the body of the connector to rotate the blades out of their locked position.

6 Claims, 10 Drawing Figures

LOCKING PLUG

This invention relates to electrical connector assemblies and, more specifically, to an improved electrical connector structure having a retractable locking member.

BACKGROUND OF THE INVENTION

Electrical connector assemblies of the locking type are well known in the connector industry. Normally, the female portion of such a connector assembly is provided with three or more arcuate circularly arranged slots, and the male portion is provided with an equal number of slightly arcuate blades, the blades being dimensioned and arranged so that they can be inserted in the slots by simple axial movement of the male connector body and then, by rotation of one or both of the connector portions, the blades are moved into a position from which they cannot be separated by simple axial movement. One or more of the blades usually has an L-shaped configuration such that the laterally extending portion of the L engages a recess within the slot as a result of the rotation.

The male and female portions can take various configurations, but the male portion is usually a plug connected to the end of a multi-conductor cable. The female portion may also terminate a similar cable, or it can be a fixture mounted in a partition or on a piece of equipment. In any event, it is possible for the cable attached to the male portion to be subjected to various forces which might tend to rotate the cable, and also the male connector portion, in the unlocking direction, thereby causing inadvertent unlocking and extraction of the blades from the slots.

To prevent this kind of undesired extraction, there has been an effort to develop connectors which have greater resistance to accidental disconnection or which have locking devices capable of precluding such accidental disconnection. Examples of locking connectors and connectors having supplemental locking devices are found in the following U.S. Patents.

| | |
|---|---|
| 2,684,860 | Rafferty |
| 2,750,571 | Schmier |
| 3,120,987 | Degnan et al |
| 3,390,404 | Murchison |
| 3,393,395 | Hubbell |
| 3,500,291 | Hubbell et al |
| 3,739,321 | Murphy et al |
| 3,790,914 | Hough |
| 3,888,559 | Geib |
| 3,890,025 | Gray |
| 3,950,059 | Anhalt et al |

A particularly good example is found in U.S. Pat. No. 3,500,291 which includes a connector having locking blades and also a retractable pin. The pin protrudes from the face of the male connector portion, parallel with the blades, and in the fully engaged, locked position, enters a slot behind a blade which it follows, protruding into the face of the female portion. To detach the two connectors, the male connector portion is provided with an axially movable sleeve coupled to the locking pin. One simply moves the sleeve axially, thereby retracting the locking pin from the slot, and then rotates the male connector portion in the unlocking direction (counter-clockwise, as shown in the patent, and as normally constructed) and then, by a further axial movement, withdraws the blades from the slots.

While this is a fully satisfactory arrangement insofar as the locking function itself is concerned, it presents certain difficulties. As will be recognized, in order to detach the two connector portions from each other, one must know in advance that it is necessary to perform three separate movements in different directions, i.e., axial, then rotational, then axial. One unfamiliar with the specific type of connector can be temporarily baffled by his inability to accomplish separation by either axial or rotational movement, a condition which could lead to unfortunate results in the event of an urgent need to separate the connectors.

Furthermore, in circumstances where the connector is to be exposed to severe weather conditions or moisture and is therefore to be provided with a protective elastomeric cover, it is quite difficult to provide a cover which is sufficiently sturdy to provide the necessary weatherproofing and, concurrently, sufficiently flexible in multiple directions to permit the sequence including both axial and rotational movement. Thus, the use of such connectors is somewhat limited.

BRIEF DESCRIPTION OF THE INVENTION

Accordingly, an object of the present invention is to provide a locking connector having a protruding locking member and means for retracting the locking member employing the same motion needed to normally unlock such locking connectors and detach them from each other.

A further object is to provide a locking connector assembly which can be provided with a protective boot or covering, which boot does not interfere with the locking or unlocking operations of the connector.

Briefly described, the invention includes a male electrical connector structure comprising a generally cylindrical insulating body, a plurality of locking blades supported in said body and extending from a front face thereof, said blades being shaped and dimensioned for insertion into and translation in slots formed in a mating female connector structure as said body is moved axially and angularly, respectively, a sleeve at least partially surrounding said body, means for mounting said sleeve for limited rotation relative to said body between first and second positions, and for restraining said sleeve against axial movement relative to said body, an elongated locking member normally protruding from said front face of said body when said sleeve is in said first position, and means on said sleeve for engaging said locking member and axially retracting said member into said body as said sleeve is rotated from said first position to said second position.

In order that the manner in which the foregoing and other objects are attained in accordance with the invention can be understood in detail, a particularly advantageous embodiment thereof will be described with reference to the accompanying drawings, which form a part of this specification:

DETAILED DESCRIPTION OF THE DRAWINGS

Figure 1:
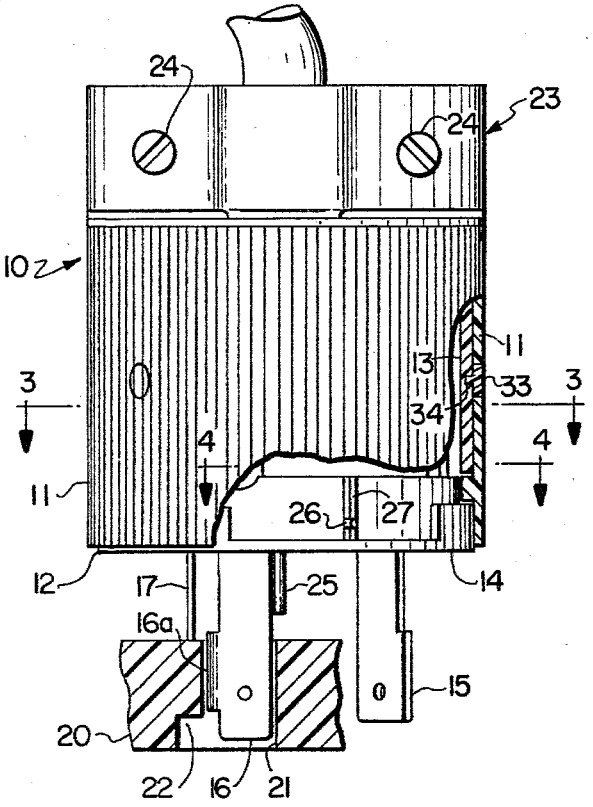
FIG. 1 is a side elevation of a locking plug in accordance with the invention, partially cut away to show internal portions thereof.
Figure 2:
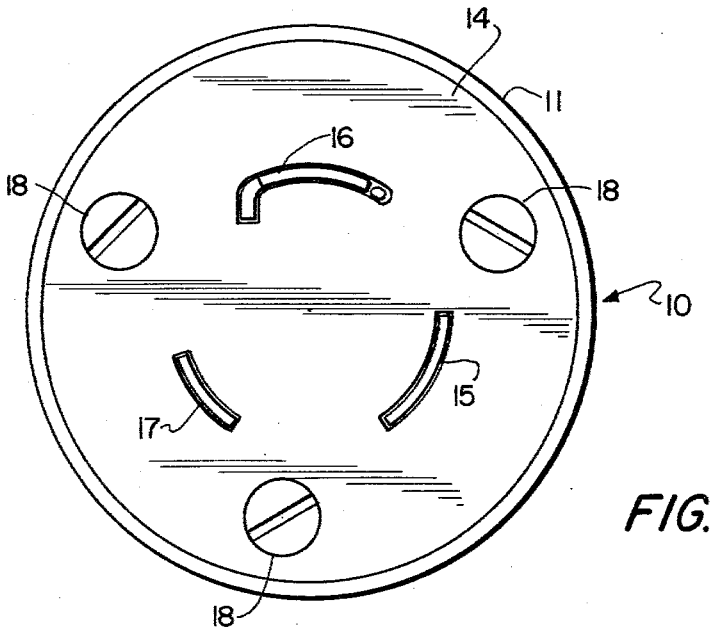
FIG. 2 is a bottom plan view of the locking plug of FIG. 1.
Figure 3:
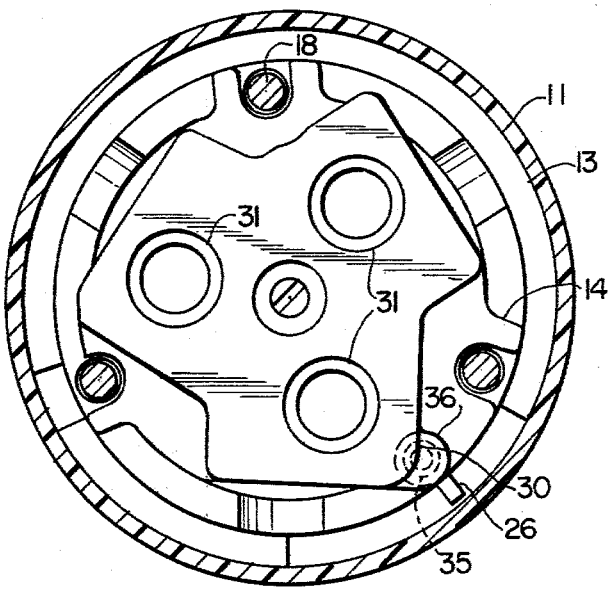
FIG. 3 is a transverse sectional view along line 3—3 of FIG. 1.

Referring now to FIGS. 1, 2 and 3, it will be seen that the male electrical plug member indicated generally at 10 includes a cylindrical sleeve 11 which surrounds a generally cylindrical insulating body 12 having two portions, one portion being an interior tubular member 13 and a disc-like end member 14 having a front face through which blades 15, 16 and 17 protrude. Portions 13 and 14 are fixedly attached to each other, in a conventional fashion, by screws 18 which pass through portion 14 and threadedly engage bosses within tubular portion 13, which will be further described.

A portion of a mating female receptacle 20 is shown in FIG. 1, the receptacle having slots to receive the three blades. One such slot 21 is illustrated, the slot having an entrance portion behind which is a larger recess 22 into which a lateral protrusion 16*a* on blade 16 is received after the blade has been fully inserted and rotated.

At the opposite end of the connector assembly from the blades is a clamping device indicated generally at 23 for permitting an electrical cable to pass into the interior of the connector and for firmly clamping the cable. This clamping mechanism can take several forms but, in the form illustrated, the clamp has two halves, one of which is generally semi-circular in cross-section and is formed as an extension of body portion 13. The other portion is a similar semi-circular member which is attachable to the first by screws 24, each portion having a circular indentation to engage approximately half of the cable.

Of particular relevance to the present invention is the provision of a locking pin 25 which protrudes from the front face of body portion 14 and extends therethrough. It will be observed that pin 25 is directly adjacent the trailing edge of blade 16, that it passes through body 14, and that it is axially movable in body 14 relative to that body and blade 16. As will be further described, pin 25 is generally L-shaped and the other end of the L forms an operating member 26 which protrudes radially through an axially extending slot 27 in body 14. Thus, the operating member 26 is axially movable with pin 25 in the slot.

As best seen in FIG. 3, body portion 14 is provided on its inner surface with a blade supporting assembly 30 which is, in itself, of conventional design and includes devices 31 which are conductive and electrically connected to the blade and which are designed to receive the wires from the cable entering the connector. Except for the screws, the blades, the locking pin and other hardware, all components of the device are made from electrical insulating material, preferably impact and heat resistant polymeric material.

It will be observed in FIG. 3 that the operating portion 26 of the locking pin structure protrudes radially from body 14 to a point just inside of the inner surface of sleeve 11. As seen in FIG. 1, sleeve 11 is provided with a plurality of inserts 33, each insert having an inwardly protruding tongue 34 which rests in an annular groove formed on the exterior surface of tubular body portion 13. These tongues 34 prevent relative axial movement between portions 11 and 13, but permit relative rotational movement. Other shoulders and guide surfaces can similarly be provided on the two members to serve this purpose.

As will be seen from FIG. 1, when connector 10 is moved axially such that the blades are inserted into the slots in receptacle 20, pin 25 engages the exposed face of the receptacle and is pushed into body portion 14. Then, when plug 10 is rotated clockwise, blade 16 being moved to the left, in FIG. 1, the trailing edge of blade 16 moves away from the adjacent surface of the slot in which it has been inserted, leaving a gap into which pin 25 can extend. As will be described, pin 25 is spring urged toward its protruding position, so that the pin enters the vacated portion of the slot as soon as the space becomes available. Once pin 25 is in the slot, the plug cannot be rotated counterclockwise to disengage blade 16 from the slot because the pin obstructs such movement. Thus, a mechanism is needed to extract the pin to permit such disengagement.

Figure 4:
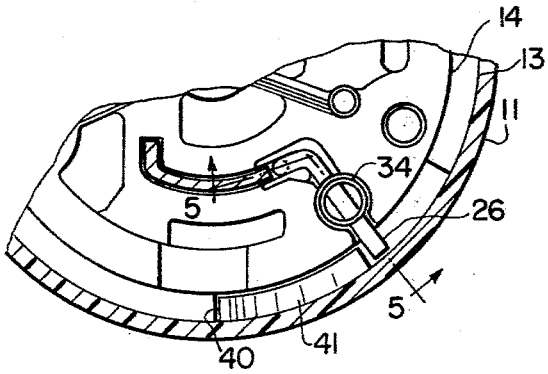
FIG. 4 is a partial transverse sectional view along line 4—4 of FIG. 1.
Figure 5:
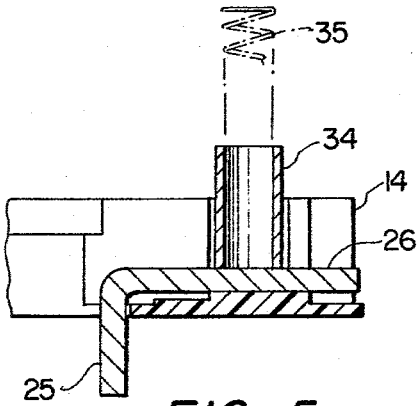
FIG. 5 is an enlarged fragmentary side elevation, in section, along line 5—5 of FIG. 4.
Figure 6:
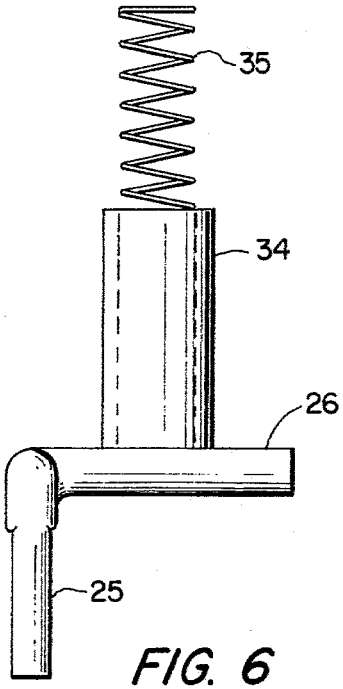
FIG. 6 is an enlarged elevation of a locking pin usable in the plug of FIGS. 1–5.
Figure 7:
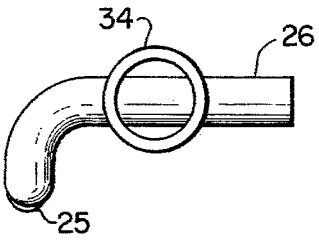
FIG. 7 is a top plan view of the locking pin of FIG. 6.

FIG. 4 shows, in plan, a portion of the plug and illustrates in greater detail the construction of the locking member including pin 25 and operating member 26. The sectional view of FIG. 5 also shows, somewhat enlarged, this same structure. As seen in these figures, and also in the enlarged detailed views of FIGS. 6 and 7, the locking member is L-shaped in two directions, and is fixedly attached to a spring retaining tube 34 which receives a compression coil spring 35. Spring 35 is received within a socket 36 in block 30, which is a part of body portion 14, such that the spring is, at its fullest extension, under some compression. Tube 34 is capable of moving axially with pin 25 and operating member 26.

Figure 9:
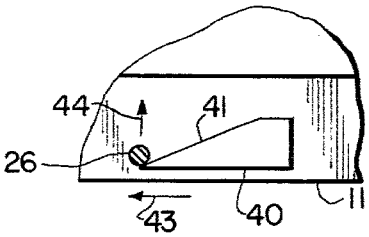
FIG. 9 is an enlarged fragmentary elevation of a cam element along line 9—9 of FIG. 8.

Fixedly attached to the inner surface of sleeve 11 is an inwardly protruding cam member 40 having a cam surface 41, best seen in FIGS. 4 and 9. Surface 41 is inclined with respect to the central axis of the plug such that when sleeve 11 is rotated in a counterclockwise direction relative to body portions 13 and 14, the lower end of the cam surface abuts the lower portion of operating member 26, tending to push it upwardly. As shown in FIG. 9, the counterclockwise rotation is illustrated by arrow 43 and the upward movement of the pin by arrow 44.

Figure 8:
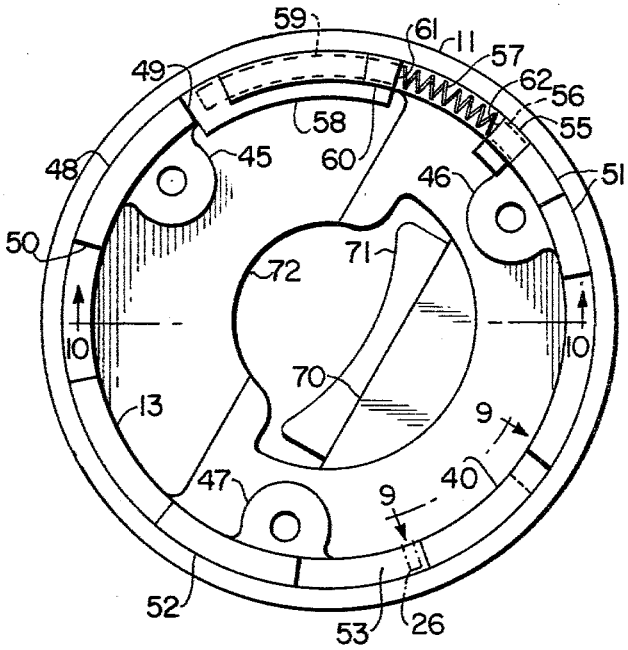
FIG. 8 is a bottom plan view of sleeve and cover assembly portions of the plug of FIGS. 1 and 2, the view being similar to FIG. 2 but with internal components removed.

FIG. 8 is an interior view of the assembly including sleeve 11 and body 13 with body portion 14 removed. The previously mentioned bosses for receiving the threaded ends of screws 18 to hold portion 14 in place are bosses 45, 46 and 47, these being integrally formed with the molded body 13. Body 13 also includes an elongated portion 48 having an exposed end surface, seen in FIG. 8, which abuts the inner end of portion 14 when assembled. Portion 48 also has an end stop surface 49 which lies in a plane passing through the central axis of the body, and the opposite end also forms a stop surface 50, lying in a similar plane. Angularly separated from elongated portion 48 is an elongated portion 51, also having an end surface to abut portion 14, and an elongated portion 52 having a similar end face. A recessed region 53 lies axially inwardly of the cam member 40 which is attached to the inner surface of sleeve 11.

Figure 10:
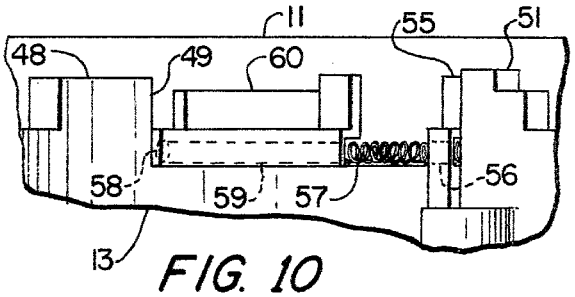
FIG. 10 is a fragmentary view along line 10—10 of FIG. 8.

Adjacent portion 51, and lying between portions 51 and 48, is a socket member 55 which is integrally formed with, or fixedly attached to, body 13 adjacent member 51. Socket portion 55 has a circularly extending bore 56 passing therethrough, bore 56 having an axis which lies in a plane perpendicular to the central axis of the plug. Bore 56 receives one end of a compression coil spring 57, the end of the spring abutting one axially extending surface of portion 51, this being best seen in FIG. 10.

The other end of spring 57 is engaged in a portion of the apparatus which is attached to, and movable with, sleeve 11. This includes a body 58 which has a bore 59 extending therethrough, bore 59 being arcuately curved to conform to the arcuate shape of the interior of sleeve 7 and the slightly arcuate configuration of body 58. A body 60 is mounted on sleeve 11 above body 58 as an additional securing member.

It will be observed that bodies 58 and 60 present an end face 61 which faces toward an end face 62 of socket member 55. Faces 61 and 62 are stop faces which abut each other as sleeve 11 is rotated relative to body 13, in a clockwise direction as viewed in FIG. 8, or in the direction of arrow 43 in FIG. 9, compressing spring 57 into sockets 56 and 59. The abutment of faces 61 and 62 defines the limit of relative rotational movement in the direction of compression of spring 57.

When the bodies are released, the force of spring 57 forces faces 61 and 62 apart, moving sleeve 11 in the opposite direction and causing the opposite end of body 58 to abut surface 49, thereby defining the opposite limit of movement. As will be recognized, pin 26 is restrained against circular movement by its position in slot 27 so that the movement of the sleeve with body 58 causes similar movement, on the other side of the plug, of cam member 40 relative to operating member 26, causing the camming action described in connection with FIG. 9.

FIG. 8 also shows a portion of the cable clamping assembly 23 including a movable semi-cylindrical body 70 having radial protrusions (one or more) 71. The fixed portion of the clamping assembly has an inner arcuate curved surface 72 so that when screws 24 are tightened the cable is engaged between surface 72 and member 71, firmly gripping the cable.

While one advantageous embodiment has been chosen to illustrate the invention, it will be understood by those skilled in the art that various changes and modifications can be made therein without departing from the scope of the invention as defined in the appended claims.

What is claimed is:

1. A male electrical connector structure comprising a generally cylindrical insulating body;

a plurality of locking blades supported in said body and extending from a front face thereof, said blades being shaped and dimensioned for insertion into and translation in slots formed in a mating female connector structure as said body is moved axially and angularly, respectively;

a sleeve at least partially surrounding said body;

means for mounting said sleeve for limited rotation relative to said body between first and second positions and for restraining said sleeve against axial movement relative to said body;

an elongated locking member normally protruding from said front face of said body when said sleeve is in said first position; and means on said sleeve for engaging said locking member and axially retracting said member into said body as said sleeve is rotated from said first position to said second position.

2. A connector structure according to claim 1 wherein said locking member includes an elongated pin having a significantly smaller cross sectional area than said blades, and spring means in said body for urging said pin toward its normal, protruding position.

3. A connector structure according to claim 2 wherein each of said blades includes a leading edge and a trailing edge, said leading edge facing in the locking direction of angular rotation of said body with said blades in the slots of the mating connector, and wherein said pin protrudes from said front face adjacent the trailing edge of one of said blades whereby, upon insertion of said blades in the slots and rotation of said body in the locking direction, said pin enters that portion of the slot behind the trailing edge of said one of said blades.

4. A connector structure according to claim 2 wherein said locking member further includes an operating arm disposed within said body and fixedly attached to said elongated pin, said operating arm protruding generally radially from said body to a location adjacent an inner surface of said sleeve.

5. A connector structure according to claim 4 wherein said means on said sleeve for retracting said member includes means protruding inwardly from the inner surface of said sleeve and defining a cam surface inclined relative to the axis about which said sleeve rotates, said cam surface being operative to engage and axially move said operating arm upon rotation of said sleeve toward said second position.

6. A connector structure according to claim 1 and further comprising spring means for urging said sleeve toward said first position, said spring means including a compression coil spring;

a radially outwardly extending member on said body;

a radially inwardly extending member on said sleeve, each of said radially extending members having a face with a socket formed therein to receive one end of said coil spring, said members being axially aligned so that, in said second position, said faces are abutting and said sockets are substantially coaxially aligned with each other.

* * * * *